US008374058B2

(12) United States Patent
Karapatis et al.

(10) Patent No.: US 8,374,058 B2
(45) Date of Patent: Feb. 12, 2013

(54) GONG FOR TIMEPIECE STRIKING WORK

(75) Inventors: Nakis Karapatis, Premier (CH); Jérôme Favre, Les Bioux (CH); Alain Zaugg, Le Brassus (CH)

(73) Assignee: Montres Breguet SA, L'Abbaye (SE)

( * ) Notice: Subject to any disclaimer, the term of this patent is extended or adjusted under 35 U.S.C. 154(b) by 180 days.

(21) Appl. No.: 12/868,958

(22) Filed: Aug. 26, 2010

(65) Prior Publication Data

US 2011/0051568 A1 Mar. 3, 2011

(30) Foreign Application Priority Data

Aug. 26, 2009 (EP) ..... 09168726

(51) Int. Cl.
*G04B 19/00* (2006.01)

(52) U.S. Cl. ..... 368/273

(58) Field of Classification Search ..... 368/72, 368/269–273, 276, 243–244, 267, 315; 968/226; 116/152, 162
See application file for complete search history.

(56) References Cited

U.S. PATENT DOCUMENTS

| | | | | |
|---|---|---|---|---|
| 1,001,095 | A | 8/1911 | Towns | |
| 7,065,005 | B2 * | 6/2006 | Rochat | 368/72 |
| 7,708,458 | B2 * | 5/2010 | Karapatis | 368/315 |
| 7,742,365 | B2 * | 6/2010 | Moteki et al. | 368/269 |
| 2008/0192585 | A1 * | 8/2008 | Corthesy et al. | 368/268 |
| 2009/0059736 | A1 | 3/2009 | Moteki et al. | |
| 2011/0051567 | A1 * | 3/2011 | Karapatis et al. | 368/273 |

FOREIGN PATENT DOCUMENTS

| | | | |
|---|---|---|---|
| DE | 443 387 | C1 | 4/1927 |
| FR | 2 480 453 | A1 | 10/1981 |

OTHER PUBLICATIONS

European Search Report issued in corresponding application No. EP 09 16 8726, completed Feb. 9, 2010.

* cited by examiner

*Primary Examiner* — Edwin A. Leon
(74) *Attorney, Agent, or Firm* — Griffin & Szipl, P.C.

(57) ABSTRACT

The striking work device of a timepiece includes a gong (4) surrounding a movement and extending in approximately one plane, and a gong-carrier secured to a watch plate of the timepiece. The gong is fixed to the gong-carrier. At least one hammer (6) of the striking work device strikes an impact surface (8) of the gong (4) to cause the gong to vibrate. The surface (8) of the gong, which the hammer strikes, is inclined relative to the normal to the one plane.

8 Claims, 1 Drawing Sheet

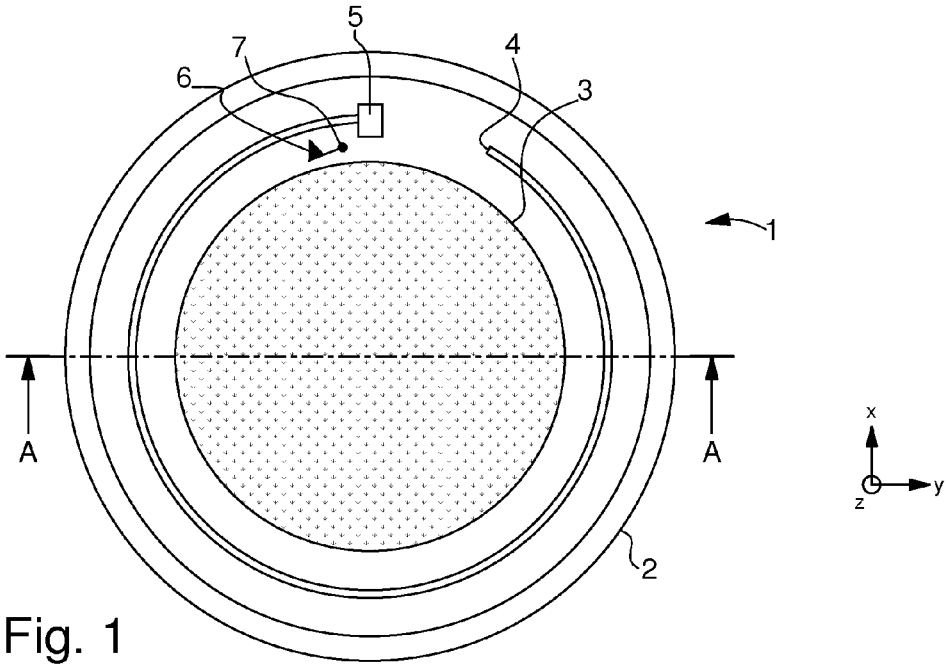
Fig. 1
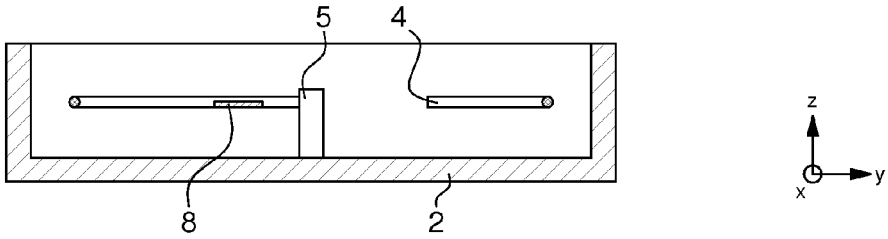
Fig. 2 A-A
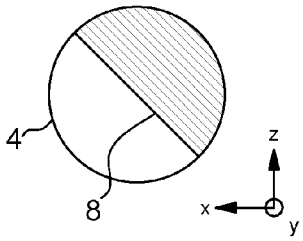
Fig. 3
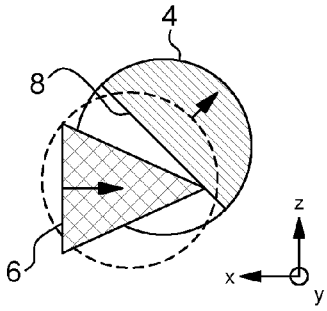
Fig. 4

GONG FOR TIMEPIECE STRIKING WORK

This application claims priority from European Patent Application No. 09168726.9 filed Aug. 26, 2009 of which is incorporated herein by reference.

FIELD OF THE INVENTION

The invention concerns watch striking works, and in particular watches with a mechanical striking work including a gong which is struck by a hammer to generate vibrations.

BACKGROUND OF THE INVENTION

In the watchmaking field, a conventional architecture is used to make movements which are fitted with striking mechanisms, such as minute-repeaters. In these embodiments, the gong used is a circular metal wire placed in a parallel plane to the watch dial. The metal wire is arranged around the movement, inside the watch frame. One end of the gong is fixed, for example by a brazing-solder, to a gong-carrier. The other end of the gong is generally free. The gong-carrier is secured to the watch plate and holds the metal wire above the watch plate. The watch includes a hammer which is activated at predetermined times. The gong vibration is produced by the impact of the hammer on the gong of the gong-carrier. The hammer makes a partial rotation in the plane of the gong to make the gong vibrate in its plane. Part of the gong vibration is transmitted to the watch plate. The plate then vibrates in a parallel plane to the plane of the gong.

The vibration obtained comprises several natural frequencies, the number and intensity of which, particularly within the audible field, depend upon the geometry of the gong and the physical properties of the material. Generally, to produce a musical sound of fixed pitch in the entire sound spectrum, there is a fundamental frequency, which is also called the first harmonic, and one or several harmonics, which are integer multiples of the fundamental frequency. In other cases where frequencies higher than the fundamental are not whole multiples of the lowest frequency, they are defined as "partials". A sound with several partials is found mainly in percussion instruments, or some string instruments, or during strike transients, such as the shock or impact of a hammer against the gong of a watch striking work.

In practice, the ring volume is relatively limited and the energetic yield of the striking work is relatively low. Moreover, the sound quality of the striking work remains generally poor because the transmitted sound has a low number of natural frequencies.

There also exists, in the state of the art, a striking mechanism embodiment, which is formed of a hammer, rotatably mounted about an axis of rotation that is perpendicular to a base plate, for striking a bell fixed to the base plate. U.S. Pat. No. 1,001,095 A and FR Patent No. 2 480 453 A1 can be cited in this regard. The bell fixed to the base plate can also be replaced by a spiral-shaped gong, as disclosed in DE Patent No. 443 387 C. However, none of these embodiments provides a relatively high ring volume and sufficient sound quality.

SUMMARY OF THE INVENTION

It is an object of the invention to overcome all or some of these drawbacks.

The invention thus concerns a watch that includes a striking work device including:

a gong with a bar surrounding a movement and extending in approximately one plane, a gong-carrier secured to a watch frame, the gong being fixed to the gong-carrier, at least one hammer for striking the gong to cause said gong to vibrate.

Said watch is characterized in that the hammer is arranged to strike an impact surface of the gong, which is inclined relative to the normal to said plane.

According to a variant, the gong has an elongated bar surrounding the mechanism. Said surface can be formed by a flat portion arranged on one portion of said bar.

According to another variant, there is a frame housing the movement and the gong is placed inside the frame.

According to yet another variant, the gong is made with a precious metal or a precious metal alloy.

According to a variant, said surface is placed at a distance from the location where the gong is fixed to the gong-carrier.

According to another variant, the transverse section of the bar outside said impact surface is a disc.

According to yet another variant, the gong-carrier projects relative to the bottom of the frame, which may be a plate or middle part of the watch, and in which the gong is arranged above the bottom of the frame.

One advantage of the watch according to the invention lies in the fact that the gong can be configured to optimise the yield of the watch striking work by transmitting vibrations more efficiently to the various elements of the watch movement. Because, in particular, of an inclined surface of the gong which the hammer strikes, the gong vibrations are generated in one direction of the plane of the gong and also in an orthogonal direction to the gong plane. The vibrations are therefore better propagated.

BRIEF DESCRIPTION OF THE DRAWINGS

Other features and advantages of the invention will appear clearly in the following description, given by way of non-limiting illustration, with reference to the annexed drawings, in which:

FIG. 1 is a simplified top view of an embodiment of a watch according to the invention;

FIG. 2 is a simplified diametrical cross-section of the watch of FIG. 1, without the mechanism and hammer;

FIG. 3 is an enlarged cross-section of a gong in one part of which there is a flat portion; and FIG. 4 illustrates the movement of the gong of FIG. 3 when a hammer strikes.

DETAILED DESCRIPTION OF THE INVENTION

The invention proposes a watch fitted with a striking work gong. The gong generally surrounds the watch movement and extends in approximately one plane. A hammer strikes an impact surface of the gong to make it vibrate. This surface is inclined relative to the normal to the gong plane.

When the hammer strikes the gong, the gong thus vibrates in its own plane and in the normal to its plane. The energetic yield of the gong is thus improved. Moreover, transmission of the vibrations to the watch plate is improved, since the gong-carrier can transmit not only torsion stress but also traction/compression stress to the plate. This further improves the energetic yield and can improve the spectral density of the sound generated particularly by decreasing it, which decreases dissonance due to partials at a close frequency.

FIG. 1 is a simplified top view of the inside of a watch 1 according to one embodiment of the invention. FIG. 2 is a simplified diametrical cross-section of the watch of FIG. 1. Watch 1 includes a watch plate 2. A frame is arranged in watch plate 2. Watch 1 includes a known movement 3 housed inside the frame. Movement 3 is typically a mechanical movement.

Watch 1 includes a gong 4 and a gong-carrier 5 also housed inside the frame. Gong-carrier 5 is secured to watch plate 2. Gong-carrier 5 projects relative to the bottom of watch plate 2. Gong 4 surrounds movement 3 and extends approximately into a plane x, y, which approximately matches the plane of the dial of watch 1. Gong 4 is secured via one end thereof to gong-carrier 5. The other end of gong 4 is free.

Gong-carrier 5 holds gong 4 above the bottom of watch plate 2. There is thus a clearance for the gong along axis z so that it can vibrate in that direction. Watch 1 also includes a hammer 6, which, when activated, can strike an impact surface of gong 4. Hammer 6 could also be activated every minute. Hammer 6 is pivotably mounted relative to an axis 7 perpendicular to the plane of gong 4, the axis therefore having a direction z. This hammer 6 can be activated to strike the gong on an inclined surface 8 relative to the normal to the plane of the gong. For the sake of legibility, mechanism 3 is not illustrated in FIG. 2. Preferably, this hammer 6 is mounted in proximity to the gong-carrier. However, one could also envisage mounting the hammer on the watch plate at a distance from said gong-carrier 5.

FIG. 3 is an enlarged cross-section of the gong showing an impact surface 8 which hammer 6 strikes. As illustrated, this surface 8 is inclined relative to direction z (the perpendicular direction to the plane of gong 4). Thus when one end of hammer 6 strikes this surface 8, gong 4 is also made to vibrate in direction z.

FIG. 4 shows the movement of gong 4 when hammer 6 is striking. The circle in dotted lines represents the position of gong 4 when idle. After entering into contact with impact surface 8, hammer 6 continues to move in direction x. Hammer 6 slides against surface 8. Because surface 8 is inclined relative to direction z, gong 4 is elastically deformed and undergoes a local movement with components in directions x and z as illustrated.

Gong 4 typically has a bar, for example formed by a metal wire, surrounding mechanism 3. The bar could thus be formed by a single gold wire coil. Impact surface 8 is formed by a flat portion arranged on one part of the bar. In this case the flat portion forms a plane surface, which is advantageously inclined by 45° relative to direction z. This shape is particularly easy to achieve. In this case the bar is circular, which reduces the amount of space it takes up inside the watch.

The bar will typically have a diameter of less than 1 mm, for example of around 0.6 mm. The bar illustrated forms a portion of a toroid. This portion of a toroid will advantageously extend at an angle of between 300° and 350°. The toroid may also make more than one revolution around the movement (a "cathedral gong"). The bar could also have other suitable shapes, for example a rectangular shape, for acoustic reasons. The transverse section of the bar outside impact surface 8 could then be a disc, as illustrated.

To improve the acoustic behaviour of gong 4, it is advantageously made with a precious metal or precious metal alloy.

To increase the amplitude of movement of gong 4, the surface 8 which hammer 6 strikes can be placed in proximity to or at a distance from the location where gong 4 is secured to gong-carrier 5.

The invention could apply to a wristwatch but also to other types of timepiece, such as alarm clocks.

In the illustrated example, only one end of gong 4 is secured to gong-carrier 5. The invention also applies, however, to a watch with several gong-carriers to which the gong is fixed, or to a watch wherein the gong is fixed to the gong-carrier other than by one end thereof. In the illustrated example, watch 1 has a single hammer 6.

However, a watch according to the invention could have several hammers and the gong could have several corresponding strike surfaces inclined relative to the normal to its plane. In the illustrated example, hammer 6 is pivotably mounted relative to a perpendicular axis to the plane of the gong. However, a watch according to the invention could have a hammer that can move in an inclined direction relative to the plane of the gong. Although a gong with a single winding is illustrated, the invention also applies to a gong with several superposed windings.

It should be noted that the hammer can be arranged to strike the gong in an inclined impact direction relative to the plane of the gong. In such case, the configuration of the gong can be conventional without the use of a flat portion.

What is claimed is:

1. A watch including a striking work device including:

(a) a gong with a bar surrounding a movement and extending approximately in one plane parallel to a bottom of a watch plate or a middle part of the watch;

(b) a gong-carrier secured to the watch plate or the middle part, wherein the gong is fixed to the gong-carrier; and (c) at least one hammer for striking the gong to cause the gong to vibrate, wherein the at least one hammer is pivotably mounted relative to an axis perpendicular to the one plane of the gong, wherein the at least one hammer is arranged to strike an impact surface of the gong, wherein the impact surface is inclined relative to the normal to the one plane.

2. The watch according to claim 1, wherein the gong is made of a precious metal or a precious metal alloy.

3. The watch according to claim 1, wherein said impact surface comprises a flat portion arranged on one part of said bar.

4. The watch according to claim 1, wherein said bar generally forms a circle or a rectangle.

5. The watch according to claim 1, further comprising a frame in the watch plate for housing the movement, and the gong is arranged inside the frame.

6. The watch according to claim 1, wherein the gong is fixed to the gong-carrier by at least one of the ends of said gong.

7. The watch according to claim 1, wherein tithe transverse section of the bar outside said impact surface is a disc.

8. The watch according to claim 1, wherein the impact surface is inclined relative to the normal to the one plane by an angle of 45°.

* * * * *